US006641173B2

(12) United States Patent
Wood

(10) Patent No.: US 6,641,173 B2
(45) Date of Patent: Nov. 4, 2003

(54) TAX STAMP PERFORATOR AND NOTCHER

(75) Inventor: John P. Wood, Crestwood, KY (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 10/115,399

(22) Filed: Apr. 4, 2002

(65) Prior Publication Data

US 2002/0113429 A1 Aug. 22, 2002

Related U.S. Application Data

(62) Division of application No. 09/364,886, filed on Aug. 2, 1999, now Pat. No. 6,401,586.

(51) Int. Cl.[7] ..... G09F 3/00

(52) U.S. Cl. ..... 283/71; 40/312; 206/242; 206/264; 206/807; 283/81; 283/105; 428/43

(58) Field of Search ..... 283/71, 81, 101, 283/105; 40/312, 299.01; 428/40.1, 42.2, 42.3, 43; 206/242, 254, 264, 807

(56) References Cited

U.S. PATENT DOCUMENTS

| | | | | | |
|---|---|---|---|---|---|
| 1,836,228 | A | * | 12/1931 | Dryer | 206/264 |
| 1,991,412 | A | * | 2/1935 | O'Connor | 229/87.13 |
| 2,009,835 | A | * | 7/1935 | Burke | 206/264 |
| 2,321,112 | A | * | 6/1943 | Tamarin | 206/247 |
| 2,325,022 | A | * | 7/1943 | Aegerter | 206/264 |
| 3,695,422 | A | * | 10/1972 | Tripodi | 206/232 |
| 4,018,640 | A | * | 4/1977 | Amberg | 156/203 |
| 4,462,851 | A | * | 7/1984 | Colgate, Jr. | 156/212 |
| 4,778,962 | A | * | 10/1988 | Shimada | 206/254 |
| 4,779,733 | A | * | 10/1988 | Kilian | 206/459.5 |
| 5,031,645 | A | * | 7/1991 | Kim | 131/329 |
| 5,168,883 | A | * | 12/1992 | Winn | 131/283 |
| 5,411,295 | A | * | 5/1995 | Bates et al. | 283/105 |
| 5,515,965 | A | * | 5/1996 | Boldrini et al. | 206/264 |
| 5,866,183 | A | * | 2/1999 | Small | 206/459.5 |
| 5,931,292 | A | * | 8/1999 | Focke et al. | 206/264 |
| 5,983,600 | A | * | 11/1999 | Heide et al. | 156/DIG. 4 |
| 6,036,006 | A | * | 3/2000 | Focke | 206/264 |
| 6,401,586 | B1 | * | 6/2002 | Wood | 83/668 |
| 6,536,587 | B2 | * | 3/2003 | Wachter | 206/254 |

* cited by examiner

*Primary Examiner*—Monica Carter
(74) *Attorney, Agent, or Firm*—Connolly Bove Lodge & Hutz LLP

(57) ABSTRACT

A tax stamp perforator and notcher applies a diagonal line of spaced apart perforations on a tax stamp for subsequent application to a cigarette pack. The stamp is glued or otherwise applied to the cigarette pack normally across the back of the pack and one of the sides thereof. When the cigarette pack is opened the tax stamp is torn along the line of perforations. In order to facilitate rapid application of tax stamps to a production line of cigarette packs, notches in the form of lines of increased densification are applied to each stamp in the area where the stamp is bent around the side of the cigarette pack. These lines of increased densification are arranged parallel to the edge of the cigarette pack, and preferably one of the lines lies along the edge of the cigarette pack to thereby reduce the ability of the tax stamp to spring back away from the pack when glued to the pack. This feature enables the stamps to be applied to the packs at high production rates.

3 Claims, 2 Drawing Sheets

TAX STAMP PERFORATOR AND NOTCHER

CROSS-REFERENCE TO RELATED APPLICATION

The present application is a division of application Ser. No. 09/364,886, filed Aug. 2, 1999, now U.S. Pat. No. 6,401,586.

BACKGROUND OF THE INVENTION

The present invention relates to a tax stamp perforator and notcher and a tax stamp, and more particularly to a tax stamp having notches in the form of lines of increased densification to facilitate application of the stamp to a cigarette pack across the back and one side of the pack in a manner that reduces the ability of the stamp to spring back and thereby enable tax stamp application to cigarette packs at high production speeds.

Prior to the present invention tax stamps have been applied in a sidewinder fashioned to cigarette packs extending across the back of each pack and across one side of the pack. When placed across the cigarette pack in sidewinder fashion, tax stamps have a tendency to spring away from contact with the front and/or sides of the packs. Often the stamps do not lay flat and do not adhere to the packs because of the memory of the stamp and its tendency to spring back away from contact with the pack and return to its planar condition. Prior to the present invention, the only method found to correct this problem was to slow the production process and allow the stamp applicator more time to apply the stamp to each pack. This additional time allowed the glue on the stamp to adhere to the cigarette pack. A stamp applicator which normally applies stamps at a rate of 400 packs a minute was slowed to a production rate of approximately 320 packs per minute in order to facilitate proper application of the tax stamp to the cigarette packs. This reduction in production speed is inefficient and costly.

SUMMARY OF THE INVENTION

Accordingly, one of the objects of the present invention is a particular tax stamp having perforations and notches therein which enable efficient application of the stamp to the back and side of a cigarette pack at normal production rates without the need to slow the production process.

Another object of the present invention is a tax stamp perforator and notcher device which imparts desired properties to a tax stamp to facilitate efficient application of a stamp to a pack of cigarettes.

Still another object of the present invention is a tax stamp perforator and notcher which is simple in construction and easy to use in applying desired properties to tax stamps to facilitate efficient application of the stamps to cigarette packs.

In accordance with the present invention a generally rectangular tax stamp for application to individual cigarette packs has relatively long and short sides. A diagonal line of spaced apart perforations extend across the stamp to facilitate tearing of the stamp when the cigarette pack is initially opened. A plurality of spaced apart notches on the stamp in the form of lines of increased densification extend at least partially across the stamp generally parallel to the short sides thereof. These lines of increased densification enable application of the tax stamp to the cigarette pack at high production rates by at least partially destroying the memory of the stamp to return to its planar condition.

Preferably, the lines of increased densification comprise three lines parallel to one another, and each line extends across the tax stamp between the long sides thereof with a central interrupted portion of the line having no densification. When the tax stamp is applied to a cigarette pack across the back of the pack and one of the sides thereof, one of the lines of increased densification is normally located on the edge of the cigarette pack.

The present invention also includes a tax stamp perforator and notcher assembly comprising a drum constructed and arranged for rotary movement about an axis of rotation. The drum has an exterior cylindrical surface, and a plurality of spaced apart cutter blades are arranged along a curved diagonal on the exterior cylindrical surface. A plurality of spaced apart indenting blades are also positioned on the exterior cylindrical surface of the drum, and each of the indenting blades has an orientation generally parallel to the axis of rotation of the drum. An idler pressure roll engages the exterior cylindrical surface of the drum and defines a roller nip with the drum. Blank tax stamps received within the roller nip are provided with a diagonal line of perforations by the cutter blades, as well as spaced apart notches in the form of lines of increased densification by the indenting blades.

Preferably, the plurality of spaced apart indenting blades comprises three blades parallel to one another and extending across the drum each with a central interrupted portion without indenting blade structure. Moreover, the tax stamp perforator and notcher assembly preferably includes a housing within which the drum is journaled for rotation. A circumferential recess in the drum is engaged by a guide on the housing to maintain proper alignment of the drum within the housing as the drum rotates.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 5:
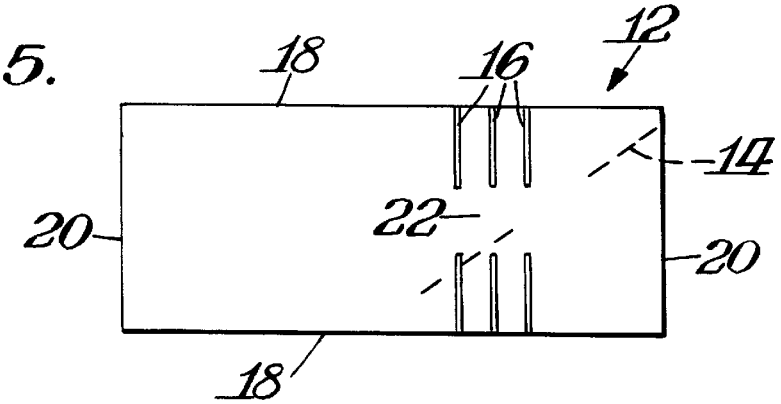
FIG. 5 is a bottom plan view of a perforated and notched tax stamp, according to the present invention.
Figure 6:
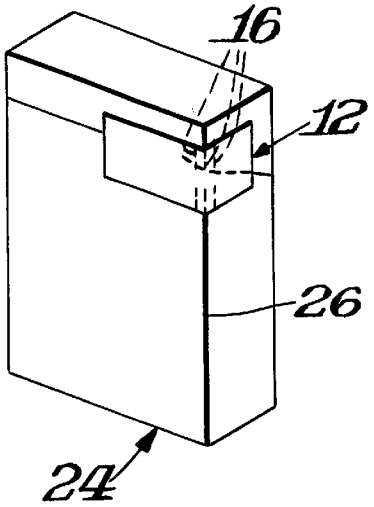
FIG. 6 is a perspective view of a cigarette pack with the perforated and notched tax stamp of FIG. 5 affixed to the pack.

Referring in more particularity to the drawings, FIGS. 1–4 illustrate a tax stamp perforator and notcher assembly 10 for providing a tax stamp 12 with a diagonal line of spaced apart perforations 14 and a plurality of spaced apart notches 16 in the form of lines of increased densification, as explained more fully below. FIG. 5 illustrates the tax stamp 12 after processing by the tax stamp perforator and notcher assembly 10. Tax stamp 12 is generally rectangular having relatively long opposed sides 18 and short opposed sides 20. The lines of increased densification 16 extend across the tax stamp generally parallel to the short sides 20.

The notches on the tax stamp in the form of lines of increased densification 16 are located on the inside of the stamp and preferably comprise three lines parallel to one another. Each line extends across the tax stamp between the long sides thereof with a central interrupted portion 22 having no densification. As explained more fully below, when the tax stamp is applied to a cigarette pack 24, one of the lines of densification is normally positioned along an edge 26 of the pack.

Returning to FIGS. 1–4, tax stamp perforator and notcher assembly 10 includes a drum 30 constructed and arranged for rotary movement about an axis of rotation 32. Drum 30 has an exterior cylindrical surface 34, and a plurality of spaced apart cutter blades 36 are arranged along a curved diagonal on the exterior cylindrical surface, as shown best in FIG. 3. Cutter blades 36 produce the diagonal line of perforations 14 on the tax stamp.

The tax stamp perforator and notcher assembly also includes a plurality of indenting blades 38 on the exterior cylindrical surface 34 of drum 30. Each of the indenting blades 38 has an orientation generally parallel to the axis of rotation 32 of the drum. An idler pressure roll 40 engages the exterior cylindrical surface of the drum and defines a roller nip 42 with the drum. Blank tax stamps 12 received within roller nip 42 are provided with the diagonal line of perforations 14 by the cutter blades 36 while the indenting blades 38 produce the notches 16 in the form of lines of increased densification.

Drum 30 is journaled within a housing 44. Bearings 46 on the housing hold drum shaft 48, and a motor 50 is connected to the shaft to rotate the drum. As shown best in FIG. 3, drum 30 includes a circumferential recess 52 and a guide 54 on housing 44 engages recess 52 to maintain proper alignment of the drum within the housing as the drum rotates.

Figure 2:
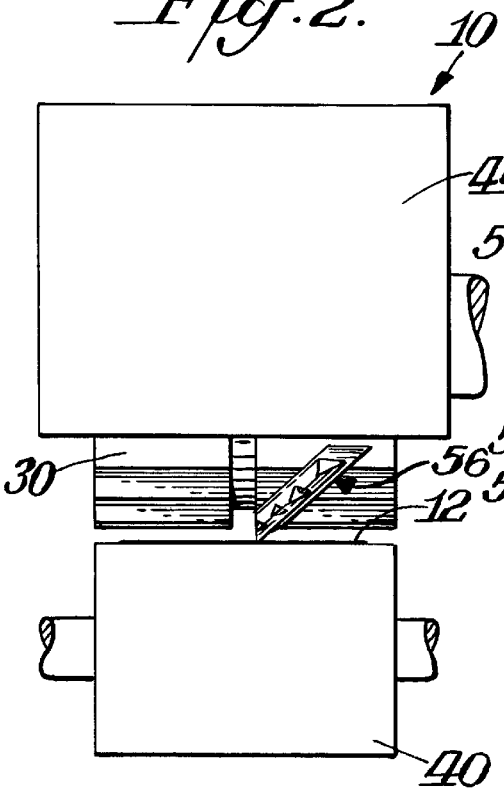
FIG. 2 is a side elevational view of the tax stamp perforator and notcher shown in FIG. 1.
Figure 1:
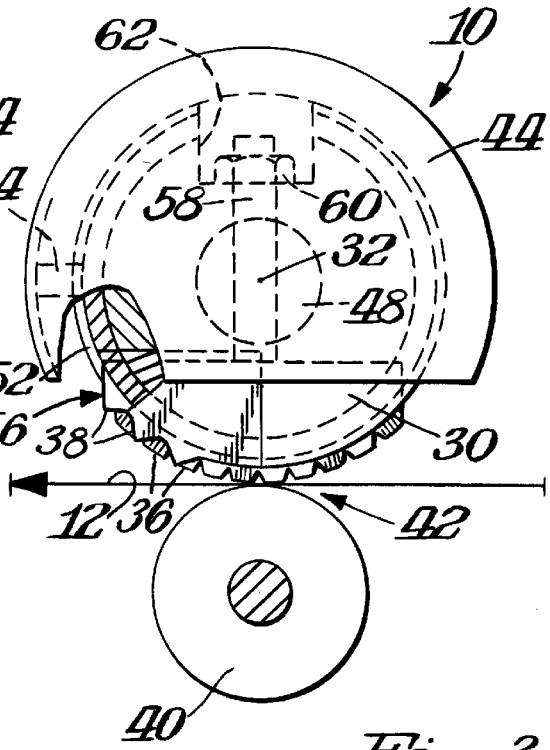
FIG. 1 is a side elevational view of a tax stamp perforator and notcher, according to the present invention.
Figure 3:
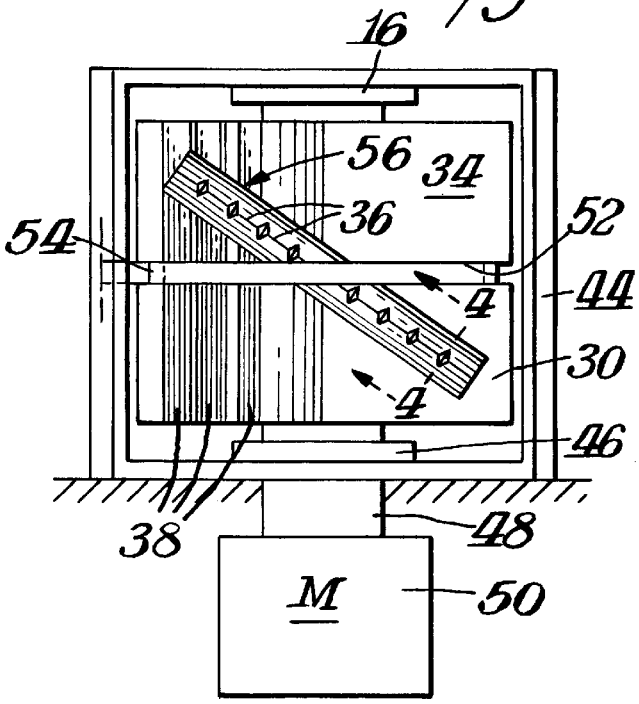
FIG. 3 is a bottom plan view of the tax stamp perforator and notcher shown in FIGS. 1 and 2.
Figure 4:
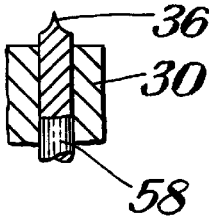
FIG. 4 is a cross-sectional view in elevation of the notcher, taken along line 44 of FIG. 3.

The plurality of cutter blades 36 are fixed to a holder 56 which is secured to drum 30 by a shaft 58 on the holder which extends into the drum. A nut 60 positioned in a cavity 62 in the drum is threaded onto shaft 58 and tightened to secure the holder 56 to the drum, as best shown in FIG. 1.

After tax stamps are processed by the tax stamp perforator and notcher assembly, the stamps are applied to a production line of cigarette packs 24 by applying a stamp to the back of each cigarette pack and one of the sides thereof. This application positions the diagonal line of perforations along the diagonal interface on the side of the pack between the body of the cigarette pack and the lid thereof. Accordingly, when the pack is initially opened the stamp is torn along the diagonal line of perforations.

Similarly, when the tax stamp is applied to cigarette pack 24, one of the notches 16 is positioned along edge 26 of the pack. The lines of increased densification 16 are located on the inside of the tax stamp next to the cigarette pack. Normally, the specifications for stamp placement allow a plus or minus of one millimeter on the pack. The three notches are spaced one millimeter apart to ensure that one notch is always in the correct location along cigarette pack edge 26 or very close thereto.

Figure 7:
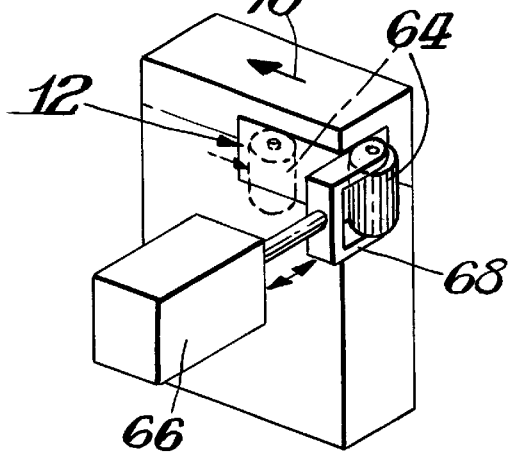
FIG. 7 is a perspective view showing a simple device for applying the perforated and notched tax stamp to a pack of cigarettes.

Application of the tax stamps to the cigarette packs is diagrammatically shown in FIG. 7 where a stamp affixing roller 64 is connected to a solenoid 66 by a yoke 68. As the packs of cigarette move in the direction of arrow 70, roller 64 applies the stamp to the back of the cigarette pack and the side of the pack upon actuation of the solenoid.

The notches in the form of lines of increased densification operate to substantially eliminate the stamp from springing back away from the cigarette pack after application. Fundamentally, the memory of the tax stamp to return to its planar position is substantially eliminated by the notches. As a result thereof, stamp application can be accomplished at high production rates of 400 packs a minute. Production rates of about 320 packs per minute are required for stamp application across the edge of a cigarette pack when, stamps without lines of increased densification are used in order to facilitate proper application of the tax stamp to cigarette packs. This allows added time for the glue on the stamp to properly adhere the stamp to the cigarette pack. With tax stamp 12 no addition time is required and high production rates of 400 packs per minute may be utilized at a substantial cost savings.

What is claimed is:

1. A generally rectangular tax stamp having relatively long and short sides, a diagonal line of spaced apart perforations extending across the stamp, substantially between the long sides thereof, and a plurality of spaced apart indentations on the stamp comprising lines of increased densification extending at least partially across the stamp generally parallel to the short sides thereof, defining a notched area, wherein the diagonal line of spaced apart perforations extend across the notched area.

2. A generally rectangular tax stamp as in claim 1 wherein the lines of increased densification comprise three lines parallel to one another.

3. A generally rectangular tax stamp as in claim 1 wherein each line of densification extends across the stamp between the long sides thereof with a central interrupted portion having no densification.

* * * * *